US012018867B2

(12) United States Patent
Yamaguchi et al.

(10) Patent No.: US 12,018,867 B2
(45) Date of Patent: Jun. 25, 2024

(54) REFRIGERATION APPARATUS

(71) Applicant: DAIKIN INDUSTRIES, LTD., Osaka (JP)

(72) Inventors: Masaki Yamaguchi, Osaka (JP); Masahiro Oka, Osaka (JP); Tomokazu Tanaka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 334 days.

(21) Appl. No.: 17/536,745

(22) Filed: Nov. 29, 2021

(65) Prior Publication Data

US 2022/0082308 A1 Mar. 17, 2022

Related U.S. Application Data

(63) Continuation of application No. PCT/JP2020/020691, filed on May 26, 2020.

(30) Foreign Application Priority Data

May 31, 2019 (JP) ..... 2019-102204

(51) Int. Cl.
*F25B 31/00* (2006.01)

(52) U.S. Cl.
CPC ..... *F25B 31/004* (2013.01); *F25B 2500/16* (2013.01); *F25B 2600/2515* (2013.01); *F25B 2700/2105* (2013.01)

(58) Field of Classification Search
CPC ..... F25B 31/004; F25B 2500/16; F25B 2600/2515; F25B 2700/2105;
(Continued)

(56) References Cited

U.S. PATENT DOCUMENTS

2010/0126211 A1 5/2010 Okamoto et al.
2010/0257894 A1* 10/2010 Fujimoto ..... F25B 13/00 165/63
(Continued)

FOREIGN PATENT DOCUMENTS

CN 102109251 A 6/2011
CN 108626907 A * 10/2018 ..... F25B 2500/16
(Continued)

OTHER PUBLICATIONS

Pdf is translation of foreign reference CN 108626907 A (Year: 2018).*
(Continued)

*Primary Examiner* — Henry T Crenshaw
*Assistant Examiner* — Kamran Tavakoldavani
(74) *Attorney, Agent, or Firm* — Birch, Stewart, Kolasch & Birch, LLP

(57) ABSTRACT

A compressor (31*a*, 31*b*) and an oil separator (35*a*, 35*b*) are provided in a refrigerant circuit (20). A flow-rate regulating valve (41*a*, 41*b*) is provided in an oil return pipe (40*a*, 40*b*) for returning a refrigerating-machine oil in the oil separator (35*a*, 35*b*) to the compressor (31*a*, 31*b*). A temperature sensor (42*a*, 42*b*) is provided downstream of the flow-rate regulating valve (41*a*, 41*b*) in the oil return pipe (40*a*, 40*b*). The oil-amount determiner (71*a*, 71*b*) determines whether an oil shortage state in which the amount of the refrigerating-machine oil held by the compressor (31*a*, 31*b*) is insufficient is present, on the basis of a measured value obtained by the temperature sensor (42*a*, 42*b*).

9 Claims, 5 Drawing Sheets

(58) Field of Classification Search
CPC ..... F25B 31/002; F25B 41/42; F25B 43/02; F25B 2400/06; F25B 2400/23; F25B 2700/03
See application file for complete search history.

(56) References Cited

U.S. PATENT DOCUMENTS

| | | | | |
|---|---|---|---|---|
| 2011/0155816 | A1 | 6/2011 | Jeong et al. | |
| 2012/0260685 | A1* | 10/2012 | Honda | F25B 29/003 62/160 |

FOREIGN PATENT DOCUMENTS

| | | | | |
|---|---|---|---|---|
| EP | 1367259 | A1 | 12/2003 | |
| EP | 1605211 | A1 | 12/2005 | |
| EP | 1367259 | A4 | 10/2009 | |
| EP | 2138158 | A1 | 12/2009 | |
| EP | 2339270 | A1 | 6/2011 | |
| EP | 2 397 793 | A1 | 12/2011 | |
| JP | 2002-242833 | A | 8/2002 | |
| JP | 2008-267787 | A | 11/2008 | |
| JP | 2009-150368 | A | 7/2009 | |
| JP | 4323484 | B2 | 9/2009 | |
| JP | 2011-2160 | A | 1/2011 | |
| WO | WO-2018079731 | A1 * | 5/2018 | F25B 1/00 |

OTHER PUBLICATIONS

Pdf is translation of foreign reference WO 2018079731 A1 (Year: 2018).*

Extended European Search Report for European Application No. 20813240.7, dated May 23, 2022.

International Search Report, issued in PCT/JP2020/020691, PCT/ISA/210, dated Aug. 11, 2020.

English translation of the International Preliminary Report on Patentability and Written Opinion of the International Searching Authority for International Application No. PCT/JP2020/020691, dated December 9, 2021.

* cited by examiner

REFRIGERATION APPARATUS

CROSS REFERENCE TO RELATED APPLICATIONS

This application is a Continuation of PCT International Application No. PCT/JP2020/020691 filed on May 26, 2020, which claims priority under 35 U.S.C. § 119(a) to Patent Application No. 2019-102204 filed in Japan on May 31, 2019, all of which are hereby expressly incorporated by reference into the present application.

TECHNICAL FIELD

The present disclosure relates to a refrigeration apparatus.

BACKGROUND ART

PTL 1 discloses a refrigeration apparatus that performs a refrigeration cycle. A refrigerant circuit of the refrigeration apparatus is provided with an oil separator on the discharge side of a compressor. In the refrigerant circuit, an oil return pipe for returning a refrigerating-machine oil in the oil separator to the compressor is connected to a suction pipe connected to the suction side of the compressor.

The refrigeration apparatus according to PTL 1 measures, upstream and downstream of a position where the oil return pipe is connected to the suction pipe, the temperature of a fluid that flows in the suction pipe and determines whether the refrigerating-machine oil present in the compressor is insufficient on the basis of a difference between the temperatures. Specifically, when the difference between the temperatures of the fluid upstream and downstream of the position where the oil return pipe is connected to the suction pipe is small, the amount of the refrigerating-machine oil that flows from the oil separator into the suction pipe through the oil return pipe is small. Accordingly, the refrigeration apparatus determines that the amount of the refrigerating-machine oil present in the compressor is insufficient.

CITATION LIST

Patent Literature

PTL 1: Japanese Unexamined Patent Application Publication No. 2011-2160

SUMMARY

A first aspect of the present disclosure is directed to a refrigeration apparatus (10) including a refrigerant circuit (20) provided with a compressor (31*a*, 31*b*), an oil separator (35*a*, 35*b*) configured to separate a refrigerant and a refrigerating-machine oil that are discharged from the compressor (31*a*, 31*b*) from each other, an oil return pipe (40*a*, 40*b*) for returning the refrigerating-machine oil in the oil separator (35*a*, 35*b*) to the compressor (31*a*, 31*b*), and a throttle mechanism (41*a*, 41*b*) configured to decompress a fluid that flows in the oil return pipe (40*a*, 40*b*). The refrigeration apparatus is configured to perform a refrigeration cycle by circulating a refrigerant in the refrigerant circuit (20). The refrigeration apparatus (10) also includes a temperature sensor (42*a*, 42*b*) configured to measure, downstream of the throttle mechanism (41*a*, 41*b*), a temperature of a fluid that flows in the oil return pipe (40*a*, 40*b*), and an oil-amount determiner (71*a*, 71*b*) configured to perform a determination operation of determining whether an oil shortage state in which an amount of the refrigerating-machine oil held by the compressor (31*a*, 31*b*) is insufficient is present, based on a measured value obtained by the temperature sensor (42*a*, 42*b*).

DESCRIPTION OF EMBODIMENTS

«Embodiment 1»

Embodiment 1 will be described. An air conditioner (10) according to the present embodiment is a refrigeration apparatus that performs a refrigeration cycle.

—Overall Configuration of Air Conditioner—

Figure 1:
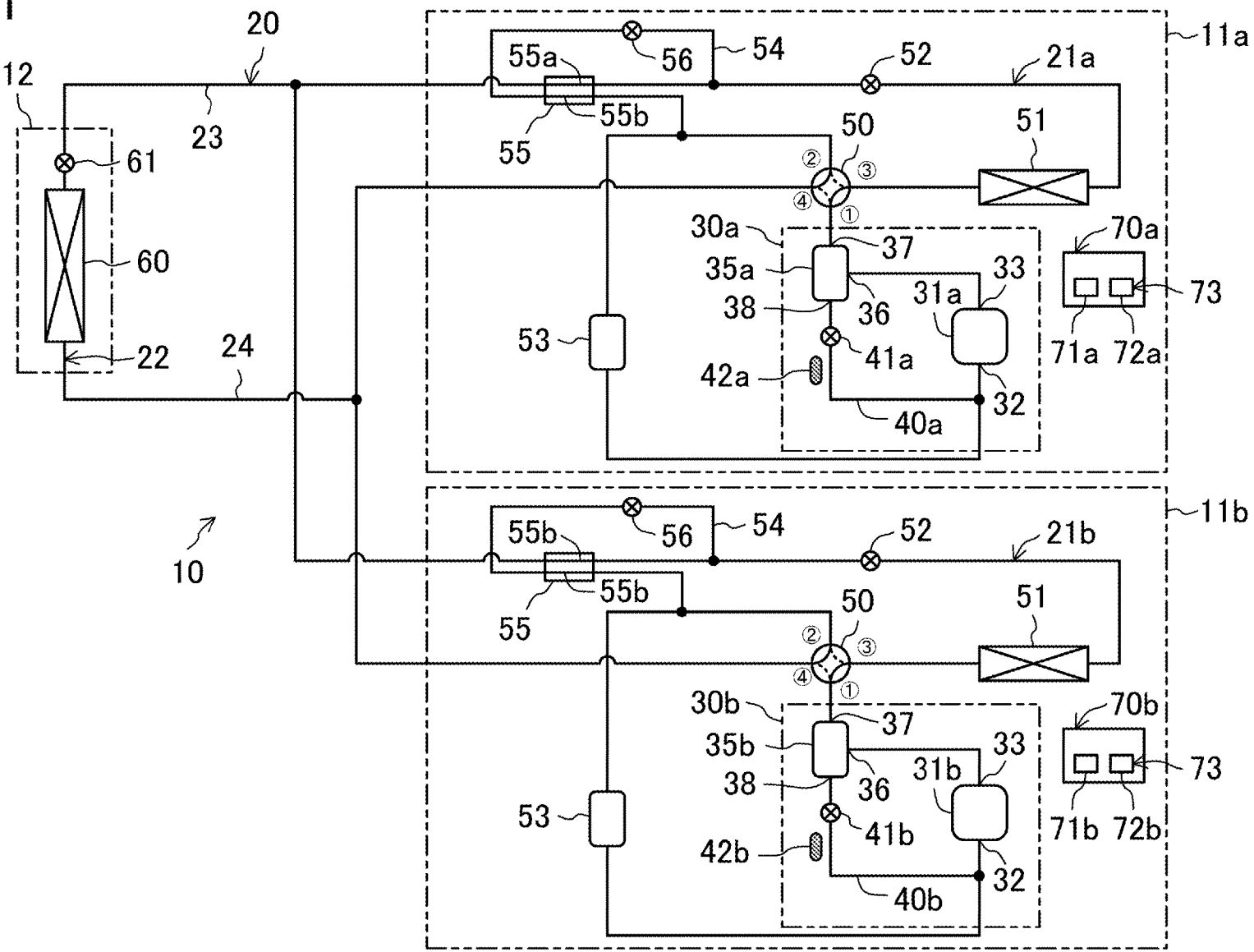
FIG. 1 is a piping system diagram illustrating a configuration of an air conditioner according to Embodiment 1.

As illustrated in FIG. 1, the air conditioner (10) according to the present embodiment includes two outdoor units (11*a*, 11*b*) and one indoor unit (12). The numbers of the outdoor units (11*a*, 11*b*) and the indoor unit (12) are merely examples. The air conditioner (10) according to the present embodiment may include three or more outdoor units (11*a*, 11*b*) and may include two or more indoor units (12).

Each of the outdoor units (11*a*, 11*b*) includes one each of an outdoor circuit (21*a*, 21*b*) and a controller (70*a*, 70*b*). Although not illustrated, each of the outdoor units (11*a*, 11*b*) is provided with an outdoor fan. The indoor unit (12) includes one indoor circuit (22). In addition, although not illustrated, the indoor unit (12) is provided with an indoor fan.

In the air conditioner (10), the outdoor circuit (21*a*, 21*b*) of each of the outdoor units (11*a*, 11*b*) and the indoor circuit (22) of the indoor unit (12) are connected to each other via a liquid-side connection pipe (23) and a gas-side connection pipe (24) and constitute a refrigerant circuit (20). In the refrigerant circuit (20), the outdoor circuits (21*a*, 21*b*) of the outdoor units (11*a*, 11*b*) are connected in parallel to each other. The air conditioner (10) performs a refrigeration cycle by circulating a refrigerant in the refrigerant circuit (20).

—Outdoor Circuit—

The outdoor circuits (21*a*, 21*b*) of the outdoor units (11*a*, 11*b*) have configurations that are identical to each other. Each of the outdoor circuits (21*a*, 21*b*) is provided with a compressor unit (30*a*, 30*b*), a four-way switching valve (50), an outdoor heat exchanger (51), an outdoor expansion valve (52), and an accumulator (53). Each of the outdoor circuits (21*a* and 21*b*) is provided with a subcooling circuit (54), a subcooling heat exchanger (55), and a subcooling expansion valve (56). The compressor unit (30*a*, 30*b*) of each of the outdoor circuits (21*a*, 21*b*) includes one each of a compressor (31*a*, 31*b*), an oil separator (35*a*, 35*b*), an oil return pipe (40*a*, 40*b*), and a flow-rate regulating valve (41*a*, 41*b*).

In each of the outdoor circuits (21*a* and 21*b*), the discharge side (specifically, an upper outlet (37), which will be described later, of the oil separator (35*a*, 35*b*)) of the compressor unit (30*a*, 30*b*) is connected to a first port of the four-way switching valve (50). The suction side (specifically, a suction pipe (32), which will be described later, of the compressor (31*a*, 31*b*)) of the compressor unit (30*a*, 30*b*) is connected to a second port of the four-way switching valve (50) via the accumulator (53).

In each of the outdoor circuits (21*a*, 21*b*), a third port of the four-way switching valve (50) is connected to one end of the outdoor heat exchanger (51), and a fourth port thereof is connected to the gas-side connection pipe (24). The other end of the outdoor heat exchanger (51) is connected to one end of the outdoor expansion valve (52). The other end of the outdoor expansion valve (52) is connected to the liquid-side connection pipe (23) via a primary-side flow path (55*a*) of the subcooling heat exchanger (55).

The four-way switching valve (50) is switchable between a first state (the state indicated by solid the lines in FIG. 1) and a second state (the state indicated by the broken lines in FIG. 1). In the four-way switching valve (50) in the first state, the first port is in communication with the third port, and the second port is in communication with the fourth port. In the four-way switching valve (50) in the second state, the first port is in communication with the fourth port, and the second port is in communication with the third port. The outdoor heat exchanger (51) causes a refrigerant that circulates in the refrigerant circuit (20) to exchange heat with outdoor air supplied by the outdoor fan. The outdoor expansion valve (52) is an electric expansion valve whose opening degree is variable.

<Subcooling Circuit>

The subcooling circuit (54) is connected at one end to a pipe that couples the outdoor expansion valve (52) to the primary-side flow path (5*a*) of the subcooling heat exchanger (55) and is connected at the other end to a pipe that couples the second port of the four-way switching valve (50) to the accumulator (53). In the subcooling circuit (54), the subcooling expansion valve (56) and a secondary-side flow path (55*b*) of the subcooling heat exchanger (55) are disposed in order from the one end to the other end.

The subcooling heat exchanger (55) causes the refrigerant that flows in the primary-side flow path (55*a*) to exchange heat with the refrigerant that flows in the secondary-side flow path (55*b*). The subcooling expansion valve (56) is an electric expansion valve whose opening degree is variable.

<Compressor Unit>

In the compressor unit (30*a*, 30*b*), a discharge pipe (33) of the compressor (31*a*, 31*b*) is connected to an inlet (36) of the oil separator (35*a*). The oil return pipe (40*a*, 40*b*) is connected at one end to a lower outlet (38) of the oil separator (35*a*, 35*b*) and is connected at the other end to the suction pipe (32) of the compressor (31*a*, 31*b*). The flow-rate regulating valve (41*a*, 41*b*) is provided in the oil return pipe (40*a*, 40*b*).

The compressor (31*a*, 31*b*) is a hermetic compressor. In the compressor (31*a*, 31*b*), a compression mechanism that sucks and compresses a fluid, and an electric motor that drives the compression mechanism are accommodated in a casing that has a hermetically sealed container shape. In the compressor (31*a*, 31*b*), the compression mechanism is lubricated with the refrigerating-machine oil stored in the casing.

The oil separator (35*a*, 35*b*) has a standing cylindrical shape. The oil separator (35*a*, 35*b*) separates a fluid (specifically, a mixture of a gas refrigerant and the refrigerating-machine oil) that has flowed into the inlet (36) into the gas refrigerant and the refrigerating-machine oil. In the oil separator (35*a*, 35*b*), the refrigerating-machine oil accumulates on the bottom portion of the oil separator (35*a*, 35*b*) and flows into the oil return pipe (40*a*, 40*b*) through the lower outlet (38). Meanwhile, the gas refrigerant flows out from the oil separator (35*a*, 35*b*) through the upper outlet (37).

The flow-rate regulating valve (41*a*, 41*b*) is an electric expansion valve whose opening degree is variable. The flow-rate regulating valve (41*a*, 41*b*) is a throttle mechanism that decompresses the fluid that flows in the oil return pipe (40*a*, 40*b*).

A temperature sensor (42*a*, 42*b*) is mounted downstream of the flow-rate regulating valve (41*a*, 41*b*) in the oil return pipe (40*a*, 40*b*). The temperature of the fluid that flows in the oil return pipe (40*a*, 40*b*) is measured downstream of the flow-rate regulating valve (41*a*, 41*b*) by the temperature sensor (42*a*, 42*b*).

—Indoor Circuit—

The indoor circuit (22) of the indoor unit (12) is provided with one each of an indoor heat exchanger (60) and an indoor expansion valve (61). In the indoor circuit (22), the indoor heat exchanger (60) and the indoor expansion valve (61) are connected to each other in series. The indoor circuit (22) is connected at one end near the indoor heat exchanger (60) to the gas-side connection pipe (24) and is connected at the other end near the indoor expansion valve (61) to the liquid-side connection pipe (23).

—Controller—

The controller (70*a*, 70*b*) of each of the outdoor units (11*a*, 11*b*) includes a central processing unit/CPU that performs arithmetic processing and a memory that stores a program, data, and the like. The controller (70*a*, 70*b*) controls a device provided at the air conditioner (10) by causing the CPU to execute the program stored in the memory.

The controllers (70*a*, 70*b*) of the outdoor units (11*a*, 11*b*) each include an oil-amount determination part (71*a*, 71*b*) and an oil-amount control part (72*a*, 72*b*). The controllers (70*a*, 70*b*) of the outdoor units (11*a*, 11*b*) are configured to be communicate with each other.

The oil-amount determination parts (71*a*, 71*b*) of the controllers (70*a*, 70*b*) each perform a determination operation. Each oil-amount determination part (71*a*, 71*b*) constitutes an oil-amount determiner. The oil-amount determination part (71*a*) of the first controller (70*a*) determines, in the determination operation, whether an oil shortage state in which the amount of the refrigerating-machine oil held by the compressor (31*a*) of the first compressor unit (30*a*) is insufficient is present on the basis of a measured value obtained by the temperature sensor (42*a*) provided at the first compressor unit (30*a*). The oil-amount determination part (71*b*) of the second controller (70*b*) determines, in the determination operation, whether the oil shortage state in which the amount of the refrigerating-machine oil held by the compressor (31*b*) of the second compressor unit (30*b*) is insufficient is present on the basis of a measured value obtained by the temperature sensor (42*b*) provided at the second compressor unit (30*b*).

The oil-amount control parts (72*a*, 72*b*) of the controllers (70*a*, 70*b*) communicate with each other to thereby each constitute an oil-amount controller (73). When the oil-amount determination part (71*a*, 71*b*) of one of the controllers (70*a*, 70*b*) determines that the oil shortage state is present, the oil-amount control part (72*a*, 72*b*) of each of the controllers (70*a*, 70*b*) performs a predetermined increase operation. The increase operation is an operation for increasing the amount of the refrigerating-machine oil that flows out together with the refrigerant from the compressor unit (30*a*, 30*b*) that has not been determined to be in the oil shortage state by the oil-amount determination part (71*a*, 71*b*) of the controller (70*a*, 70*b*).

—Working Operation of Air Conditioner—

The air conditioner (10) according to the present embodiment performs a cooling operation and a heating operation selectively.

<Cooling Operation>

The cooling operation of the air conditioner (10) will be described. During the cooling operation, the four-way switching valve (50) is set to be in the first state. In the refrigerant circuit (20), a refrigeration cycle is performed, the outdoor heat exchanger (51) of each of the outdoor units (11*a*, 11*b*) functions as a condenser, and the indoor heat exchanger (60) of the indoor unit (12) functions as an evaporator.

In the outdoor circuit (21*a*, 21*b*) of each of the outdoor units (11*a*, 11*b*), the refrigerant discharged from the compressor (31*a*, 31*b*) passes through the oil separator (35*a*, 35*b*) and the four-way switching valve (50) successively, flows into the outdoor heat exchanger (51), releases heat into outdoor air, and condenses. A portion of the refrigerant that has flowed out from the outdoor heat exchanger (51) expands when passing through the subcooling expansion valve (56) and then flows into the secondary-side flow path (55*b*) of the subcooling heat exchanger (55), and the rest of the refrigerant flows into the primary-side flow path (55*a*) of the subcooling heat exchanger (55). In the subcooling heat exchanger (55), the refrigerant that flows in the primary-side flow path (55*a*) is cooled by the refrigerant that flows in the secondary-side flow path (55*b*).

The refrigerant that has flowed out from the primary-side flow path (55*a*) of the subcooling heat exchanger (55) of each of the outdoor circuits (21*a*, 21*b*) flows into the liquid-side connection pipe (23) and flows into the indoor circuit (22) after merging. Thereafter, the refrigerant expands when passing through the indoor expansion valve (61), then flows into the indoor heat exchanger (60), absorbs heat from indoor air, and evaporates. The indoor unit (12) blows out the air cooled in the indoor heat exchanger (60) to the inside of a room.

The refrigerant that has flowed out from the indoor heat exchanger (60) flows into the gas-side connection pipe (24) and flows separately into each of the outdoor circuits (21*a*, 21*b*). In each of the outdoor circuits (21*a*, 21*b*), the refrigerant that has flowed in from the gas-side connection pipe (24) passes through the four-way switching valve (50), then merges with the refrigerant that has flowed in from the subcooling circuit (54), next passes through the accumulator (53), and then is sucked and compressed by the compressor (31*a*, 31*b*).

<Heating Operation>

The heating operation of the air conditioner (10) will be described. During the heating operation, the four-way switching valve (50) is set to be in the second state. In the refrigerant circuit (20), a refrigeration cycle is performed, the indoor heat exchanger (60) of the indoor unit (12) functions as a condenser, and the outdoor heat exchanger (51) of each of the outdoor units (11*a*, 11*b*) functions as an evaporator.

In the outdoor circuit (21*a*, 21*b*) of each of the outdoor units (11*a*, 11*b*), the refrigerant discharged from the compressor (31*a*, 31*b*) passes through the oil separator (35*a*, 35*b*) and the four-way switching valve (50) successively, next flows into the gas-side connection pipe (24), and flows into the indoor circuit (22) after merging. Thereafter, the refrigerant flows into the indoor heat exchanger (60), releases heat into indoor air, and condenses. The indoor unit (12) blows the air heated in the indoor heat exchanger (60) to the inside of a room. The refrigerant that has flowed out from the indoor heat exchanger (60) passes through the indoor expansion valve (61), then flows into the liquid-side connection pipe (23), and thereafter, flows separately into the outdoor circuits (21*a*, 21*b*).

In each of the outdoor circuits (21*a*, 21*b*), the refrigerant that has flowed in from the liquid-side connection pipe (23) flows into the primary-side flow path (55*a*) of the subcooling heat exchanger (55) and is cooled by the refrigerant that flows in the secondary-side flow path (55*b*). A portion of the refrigerant that has flowed out from the primary-side flow path (55*a*) of the subcooling heat exchanger (55) expands when passing through the subcooling expansion valve (56), then flows into the secondary-side flow path (55*b*) of the subcooling heat exchanger (55), and the rest of the refrigerant expands when passing through the outdoor expansion valve (52) and then flows into the outdoor heat exchanger (51). The refrigerant that has flowed into the outdoor heat exchanger (51) absorbs heat from outdoor air and evaporates. The refrigerant that has flowed out from the outdoor heat exchanger (51) passes through the four-way switching valve (50), then merges with the refrigerant that has flowed in from the subcooling circuit (54), next passes through the accumulator (53), and then is sucked and compressed by the compressor (31*a*, 31*b*).

—Operation of Compressor Unit—

Operation of each of the compressor units (30*a*, 30*b*) will be described. During the cooling operation and the heating operation of the air conditioner (10), each of the compressor units (30*a*, 30*b*) sucks the refrigerant from the accumulator (53), compresses the refrigerant, and discharges the compressed refrigerant toward the four-way switching valve (50).

In the compressor unit (30*a*, 30*b*), the compressor (31*a*, 31*b*) sucks the refrigerant from the accumulator (53). The compressor (31*a*, 31*b*) compresses the sucked refrigerant and discharges the compressed refrigerant toward the oil separator (35*a*, 35*b*). At that time, a portion of the refrigerating-machine oil used to lubricate the compression mechanism is discharged together with the compressed refrigerant from the compressor (31*a*, 31*b*).

The refrigerant including droplets of the refrigerating-machine oil flows into the oil separator (35*a*, 35*b*) from the compressor (31*a*, 31*b*). The oil separator (35*a*, 35*b*) separates the refrigerating-machine oil from the flowed-in refrigerant. The refrigerant from which most of the refrigerating-machine oil has been removed flows out from the oil separator (35*a*, 35*b*) through the upper outlet (37) of the oil separator (35*a*, 35*b*) toward the four-way switching valve (50). Meanwhile, the refrigerating-machine oil separated from the refrigerant accumulates on a lower portion of the oil separator (35*a*, 35*b*) and flows into the oil return pipe (40*a*, 40*b*) through the lower outlet (38). The refrigerating-machine oil that has flowed into the oil return pipe (40*a*, 40*b*) is decompressed when passing through the flow-rate regulating valve (41*a*, 41*b*), then flows into the suction pipe (32) of the compressor (31*a*, 31*b*), and is sucked together with the refrigerant that flows from the accumulator (53) toward the compressor (31*a*, 31*b*) by the compressor (31*a*, 31*b*).

—Operation of Controller—

The controller (70*a*, 70*b*) controls a device provided at the air conditioner (10). Part of a control operation performed by the controller (70*a*, 70*b*) will be described here.

<Control of Flow-rate Regulating Valve>

During the cooling operation and the heating operation of the air conditioner (10), each of the controllers (70*a*, 70*b*) controls the flow-rate regulating valve (41*a*, 41*b*) corresponding thereto. Specifically, the first controller (70*a*) provided in the first outdoor unit (11*a*) controls the flow-rate regulating valve (41*a*) provided in the first compressor unit (30*a*). The second controller (70*b*) provided in the second outdoor unit (11*b*) controls the flow-rate regulating valve (41*b*) provided in the second compressor unit (30*b*).

Each of the controllers (70*a*, 70*b*) sets the opening degree of the corresponding flow-rate regulating valve (41*a*, 41*b*) to a preset opening degree for oil returning. The opening degree for oil returning is an opening degree that is previously determined through an experiment and the like such that substantially only the refrigerating-machine oil flows in the oil return pipe (40*a*, 40*b*) in a normal operation state. The opening degree for oil returning may be a constant value or may be changed in accordance with the operation state of the compressor (31*a*, 31*b*).

<Operation of Oil-Amount Determination Part>

During the cooling operation and the heating operation of the air conditioner (10), the oil-amount determination part (71*a*, 71*b*) of each of the controllers (70*a*, 70*b*) performs a determination operation.

The oil-amount determination part (71*a*, 71*b*) of each of the controllers (70*a*, 70*b*) reads a measured value obtained by the temperature sensor (42*a*, 42*b*) of the compressor unit (30*a*, 30*b*) corresponding thereto at every time when a predetermined period (for example, 10 seconds) is elapsed. When a predetermined determination condition is established, the oil-amount determination part (71*a*, 71*b*) determines that the compressor (31*a*, 31*b*) of the corresponding compressor unit (30*a*, 30*b*) is in the oil shortage state (specifically, the amount of the refrigerating-machine oil held by the compressor (31*a*, 31*b*) is insufficient). The oil-amount determination part (71*a*, 71*b*) judges whether a determination condition that is a condition that "a decrease amount of a measured value obtained by the temperature sensor (42*a*, 42*b*) in a predetermined reference period (for example, for 2 minutes) exceeds a predetermined reference value (for example, 5° C.)" is established.

Here, a phase change does not occur in the refrigerating-machine oil even when the refrigerating-machine oil is decompressed by the flow-rate regulating valve (41*a*, 41*b*). Thus, the temperature of the refrigerating-machine oil substantially does not change. Meanwhile, a phase change occurs in the refrigerant (specifically, a portion or the entirety of the refrigerant is gasified) when the refrigerant is decompressed by the flow-rate regulating valve (41*a*, 41*b*). Thus, the temperature of the refrigerant is comparatively greatly decreased. Therefore, a change in the mixture ratio between the refrigerating-machine oil and the refrigerant in the fluid that flows in the oil return pipe (40*a*, 40*b*) changes the temperature of the fluid that flows downstream of the flow-rate regulating valve (41*a*, 41*b*) in the oil return pipe (40*a*, 40*b*). When the ratio of the refrigerating-machine oil contained in the fluid that flows in the oil return pipe (40*a*, 40*b*) is large, a comparatively large amount of the refrigerating-machine oil returns from the oil separator (35*a*, 35*b*) to the compressor (31*a*, 31*b*), and the holding amount of the refrigerating-machine oil of the compressor (31*a*, 31*b*) is ensured. Meanwhile, when the ratio of the refrigerating-machine oil contained in the fluid that flows in the oil return pipe (40*a*, 40*b*) is small, the amount of the refrigerating-machine oil that returns from the oil separator (35*a*, 35*b*) to the compressor (31*a*, 31*b*) is small, and the holding amount of the refrigerating-machine oil of the compressor (31*a*, 31*b*) may become insufficient.

Thus, the oil-amount determination part (71*a*, 71*b*) of each of the controllers (70*a*, 70*b*) monitors a temporal change in a measured value obtained by the temperature sensor (42*a*, 42*b*) of the corresponding compressor unit (30*a*, 30*b*) and, when the above-described determination condition is established, determines that the compressor (31*a*, 31*b*) of the corresponding compressor unit (30*a*, 30*b*) is in the oil shortage state. When the determination condition is established in the oil-amount determination part (71*a*, 71*b*), each controller (70*a*, 70*b*) outputs an oil shortage signal to the other controller (70*a*, 70*b*).

<Operation of Oil-Amount Control Part>

During the cooling operation and the heating operation of the air conditioner (10), the oil-amount control part (72*a*, 72*b*) of each of the controllers (70*a*, 70*b*) performs a predetermined increase operation when the determination condition is established in the oil-amount determination part (71*a*, 71*b*) of one of the controllers (70*a*, 70*b*).

When the determination condition is established in the oil-amount determination part (71*a*) of the first controller (70*a*) and when the determination condition is not established in the oil-amount determination part (71*b*) of the second controller (70*b*), the second controller (70*b*) receives the oil shortage signal that is output by the first controller (70*a*), and the oil-amount control part (72*b*) of the second controller (70*b*) performs the increase operation. In this case, the oil-amount control part (72*b*) of the second controller (70*b*) increases, in the increase operation, the opening degree of the flow-rate regulating valve (41*b*) of the second compressor unit (30*b*) to be larger than the opening degree for oil returning.

In this case, when the opening degree of the flow-rate regulating valve (41*b*) of the second compressor unit (30*b*) increases, the amount of the refrigerating-machine oil that returns from the oil separator (35*b*) to the compressor (31*b*) increases in the second compressor unit (30*b*), and the holding amount of the refrigerating-machine oil of the compressor (31*b*) increases. When the holding amount of the refrigerating-machine oil of the compressor (31*b*) increases, the amount of the refrigerating-machine oil that is discharged together with the refrigerant from the compressor (31*b*) increases. As a result, the amount of the refrigerating-machine oil that is discharged together with the refrigerant from the second compressor unit (30*b*) increases. The refrigerating-machine oil discharged together with the refrigerant from the second compressor unit (30*b*) flows together with the refrigerant in the refrigerant circuit (20), and a portion thereof flows into the outdoor circuit (21*a*) of the first outdoor unit (11*a*) and is sucked by the compressor (31*a*) of the first compressor unit (30*a*).

As described above, when the opening degree of the flow-rate regulating valve (41*b*) of the second compressor unit (30*b*) is increased by the oil-amount control part (72*b*) of the second controller (70*b*), a portion of the refrigerating-machine oil discharged from the second compressor unit (30*b*) is supplied to the compressor (31*a*) of the first compressor unit (30*a*). As a result, the amount of the refrigerating-machine oil held by the compressor (31*a*) of the first compressor unit (30*a*) increases.

Meanwhile, when the determination condition is not established in the oil-amount determination part (71*a*) of the first controller (70*a*) and when the determination condition is established in the oil-amount determination part (71*b*) of the second controller (70*b*), the first controller (70*a*) receives the oil shortage signal that is output by the second controller (70*b*), and the oil-amount control part (72*a*) of the first controller (70*a*) performs the increase operation. In this case, the oil-amount control part (72*a*) of the first controller (70*a*) increases, in the increase operation, the opening degree of the flow-rate regulating valve (41*a*) of the first compressor unit (30*a*) to be larger than the opening degree for oil returning.

In this case, when the opening degree of the flow-rate regulating valve (41*a*) of the first compressor unit (30*a*) increases, the amount of the refrigerating-machine oil that returns from the oil separator (35*a*) to the compressor (31*a*) increases in the first compressor unit (30*a*), and the holding amount of the refrigerating-machine oil of the compressor (31*a*) increases. When the holding amount of the refrigerating-machine oil of the compressor (31*a*) increases, the amount of the refrigerating-machine oil that is discharged together with the refrigerant from the compressor (31*a*) increases. As a result, the amount of the refrigerating-machine oil that is discharged together with the refrigerant from the first compressor unit (30*a*) increases. The refrigerating-machine oil discharged together with the refrigerant from the first compressor unit (30*a*) flows together with the refrigerant in the refrigerant circuit (20), and a portion thereof flows into the outdoor circuit (21*b*) of the second outdoor unit (li*b*) and is sucked by the compressor (31*b*) of the second compressor unit (30*b*).

As described above, when the opening degree of the flow-rate regulating valve (41*a*) of the first compressor unit (30*a*) is increased by the oil-amount control part (72*a*) of the first controller (70*a*), a portion of the refrigerating-machine oil discharged from the first compressor unit (30*a*) is supplied to the compressor (31*b*) of the second compressor unit (30*b*). As a result, the amount of the refrigerating-machine oil held by the compressor (31*b*) of the second compressor unit (30*b*) increases.

—Feature (1) of Embodiment 1—

The air conditioner (10) according to the present embodiment includes the refrigerant circuit (20) and performs a refrigeration cycle by circulating refrigerant in the refrigerant circuit (20). The refrigerant circuit (20) is provided with the compressor (31*a*, 31*b*), the oil separator (35*a*, 35*b*) that separates the refrigerant and the refrigerating-machine oil that are discharged from the compressor (31*a*, 31*b*) from each other, the oil return pipe (40*a*, 40*b*) for returning the refrigerating-machine oil in the oil separator (35*a*, 35*b*) to the compressor (31*a*, 31*b*), and the flow-rate regulating valve (41*a*, 41*b*) that decompresses the fluid that flows in the oil return pipe (40*a*, 40*b*). The air conditioner (10) includes the temperature sensor (42*a*, 42*b*) and the oil-amount determination part (71*a*, 71*b*). The temperature of the fluid that flows in the oil return pipe (40*a*, 40*b*) is measured downstream of the flow-rate regulating valve (41*a*, 41*b*) by the temperature sensor (42*a*, 42*b*). The oil-amount determination part (71*a*, 71*b*) of the controller (70*a*, 70*b*) performs a determination operation. The determination operation is an operation of determining whether the oil shortage state in which the amount of the refrigerating-machine oil held by the compressor (31*a*, 31*b*) is insufficient is present, on the basis of a measured value obtained by the temperature sensor (42*a*, 42*b*).

In the air conditioner (10) according to the present embodiment, the temperature of the fluid that flows in the oil return pipe (40*a*, 40*b*) is measured downstream of the flow-rate regulating valve (41*a*, 41*b*) by the temperature sensor (42*a*, 42*b*). Then, the oil-amount determination part (71*a*, 71*b*) according to the present embodiment performs a determination operation. The determination operation is an operation of determining whether the oil shortage state in which the amount of the refrigerating-machine oil held by the compressor (31*a*, 31*b*) is insufficient is present, on the basis of a measured value obtained by the temperature sensor (42*a*, 42*b*). Therefore, according to the present embodiment, the temperature of the fluid is not required to be measured upstream and downstream of the flow-rate regulating valve (41*a*, 41*b*), as in the art. It is thus possible to simplify the configuration of the air conditioner (10).

Feature (2) of Embodiment 1—

In each controller (70*a*, 70*b*) according to the present embodiment, the oil-amount determination part (71*a*, 71*b*) performs, as the determination operation, an operation of determining whether the oil shortage state is present, on the basis of a temporal change in a measured value obtained by the temperature sensor (42*a*, 42*b*).

When the state in which the refrigerating-machine oil is present in the oil separator (35*a*, 35*b*) changes to the state in which the refrigerating-machine oil is substantially not present in the oil separator (35*a*, 35*b*), the ratio of the refrigerating-machine oil in the fluid that flows in the oil return pipe (40*a*, 40*b*) changes temporally. As a result, the temperature of "the fluid that flows in the oil return pipe (40*a*, 40*b*)" downstream of the flow-rate regulating valve (41*a*, 41*b*) changes temporally. Thus, the oil-amount determination part (71*a*, 71*b*) according to the present embodiment determines, in the determination operation, whether the oil shortage state is present on the basis of a temporal change in a measured value obtained by the temperature sensor (42*a*, 42*b*).

—Feature (3) of Embodiment 1—

In each controller (70*a*, 70*b*) according to the present embodiment, the oil-amount determination part (71*a*, 71*b*) performs, as the determination operation, an operation of determining that the oil shortage state is present, when a decrease amount of a measured value obtained by the temperature sensor (42*a*, 42*b*) in a predetermined reference period exceeds a predetermined reference value.

When the state in which the refrigerating-machine oil is present in the oil separator (35*a*, 35*b*) changes to the state in which the refrigerating-machine oil is substantially not present in the oil separator (35*a*, 35*b*), the ratio of the refrigerating-machine oil in the fluid that flows in the oil return pipe (40*a*, 40*b*) decreases, and the temperature of "the fluid that flows in the oil return pipe (40*a*, 40*b*)" downstream of the flow-rate regulating valve (41*a*, 41*b*) decreases. Thus, the oil-amount determination part (71*a*, 71*b*) according to the present embodiment determines, in the determination operation, that the oil shortage state is present when a decrease amount of a measured value obtained by the temperature sensor (42*a*, 42*b*) in a predetermined reference period exceeds a predetermined reference value.

—Feature (4) of Embodiment 1

In the air conditioner (10) according to the present embodiment, the refrigerant circuit (20) includes a plurality of the compressor units (30*a*, 30*b*). Each compressor unit (30*a*, 30*b*) includes the compressor (31*a*, 31*b*), the oil separator (35*a*, 35*b*), the oil return pipe (40*a*, 40*b*), and the flow-rate regulating valve (41*a*, 41*b*). The temperature sensor (42*a*, 42*b*) is provided at each of the plurality of compressor units (30*a*, 30*b*). The oil-amount determination part (71*a*, 71*b*) performs the determination operation for each of the plurality of compressor units (30*a*, 30*b*).

In the air conditioner (10) according to the present embodiment, the refrigerant circuit (20) is provided with the plurality of compressor units (30*a*, 30*b*). The oil-amount determination part (71*a*, 71*b*) performs the determination operation individually for each compressor unit (30*a*, 30*b*) by using a measured value obtained by the temperature sensors (42*a*, 42*b*) provided at the compressor units (30*a*, 30*b*).

—Feature (5) of Embodiment 1—

The air conditioner (10) according to the present embodiment includes the oil-amount controller (73). The oil-amount controller (73) performs an increase operation. The increase operation is an operation of controlling a device provided in the refrigerant circuit (20), when the oil-amount determination part (71*a*, 71*b*) determines that some or one of the compressor units (30*a*, 30*b*) is in the oil shortage state, to increase the amount of the refrigerating-machine oil that is discharged from the compressor (31*a*, 31*b*) of "each compressor unit (30*a*, 30*b*) that has not been judged to be in the oil shortage state by the oil-amount determination part (71*a*, 71*b*)".

In the air conditioner (10) according to the present embodiment, the oil-amount controller (73) performs the increase operation when the oil-amount determination part (71*a*, 71*b*) determines that some or one of the compressor units (30*a*, 30*b*) is in the oil shortage state. When a device provided in the refrigerant circuit (20) is controlled by the oil-amount controller (73) in the increase operation, the amount of the refrigerating-machine oil that is discharged from the compressor (31*a*, 31*b*) of "each compressor unit (30*a*, 30*b*) that has not been judged to be in the oil shortage state by the oil-amount determination part (71*a*, 71*b*)" increases.

When the amount of the refrigerating-machine oil discharged from the compressor (31*a*, 31*b*) increases, the amount of the refrigerating-machine oil that flows out together with the refrigerant from the oil separator (35*a*, 35*b*) also increases. The refrigerating-machine oil that has flowed out together with the refrigerant from the oil separator (35*a*, 35*b*) flows together with the refrigerant in the refrigerant circuit (20) and is sucked together with the refrigerant by the compressor (31*a*, 31*b*) of each compressor unit (30*a*, 30*b*). As a result, a portion of the refrigerating-machine oil discharged from the compressor (31*a*, 31*b*) of "each compressor unit (30*a*, 30*b*) that has not been judged to be in the oil shortage state by the oil-amount determination part (71*a*, 71*b*)" flows into the compressor (31*a*, 31*b*) of "the compressor unit (30*a*, 30*b*) that has been judged to be in the oil shortage state by the oil-amount determination part (71*a*, 71*b*)".

Therefore, according to the present embodiment, the amount of the refrigerating-machine oil held by the compressor (31*a*, 31*b*) of "the compressor unit (30*a*, 30*b*) that has been judged to be in the oil shortage state by the oil-amount determination part (71*a*, 71*b*)" can be increased by the increase operation performed by the oil-amount controller (73).

—Feature (6) of Embodiment 1—

The refrigerant circuit (20) of the air conditioner (10) according to the present embodiment is provided with, as a throttle mechanism, the flow-rate regulating valve (41*a*, 41*b*) whose opening degree is variable. The oil-amount controller (73) performs, as the increase operation, an operation of increasing the opening degree of the flow-rate regulating valve (41*a*, 41*b*) of "each compressor unit (30*a*, 30*b*) that has not been judged to be in the oil shortage state by the oil-amount determination part (71*a*, 71*b*)".

In the increase operation, the oil-amount controller (73) according to the present embodiment increases the opening degree of the flow-rate regulating valve (41*a*, 41*b*) of "each compressor unit (30*a*, 30*b*) that has not been judged to be in the oil shortage state by the oil-amount determination part (71*a*, 71*b*)". When the opening degree of the flow-rate regulating valve (41*a*, 41*b*) of "each compressor unit (30*a*, 30*b*) that has not been judged to be in the oil shortage state by the oil-amount determination part (71*a*, 71*b*)" increases, the amount of the refrigerating-machine oil that returns from the oil separator (35*a*, 35*b*) to the compressor (31*a*, 31*b*) increases in the compressor unit (30*a*, 30*b*), the holding amount of the refrigerating-machine oil of the compressor (31*a*, 31*b*) increases, and the amount of the refrigerating-machine oil that is discharged from the compressor (31*a*, 31*b*) increases. Therefore, the amount of the refrigerating-machine oil that flows out together with the refrigerant from the oil separator (35*a*, 35*b*) of the compressor unit (30*a*, 30*b*) increases.

—Modification 1 of Embodiment 1—

In the present embodiment, the oil-amount control part (72*a*, 72*b*) of each controller (70*a*, 70*b*) may perform, as the increase operation, an operation of decreasing the opening degree of the flow-rate regulating valve (41*a*, 41*b*) of the corresponding compressor unit (30*a*, 30*b*).

When the determination condition is established in the oil-amount determination part (71*a*) of the first controller (70*a*) and when the determination condition is not established in the oil-amount determination part (71*b*) of the second controller (70*b*), the oil-amount control part (72*b*) of the second controller (70*b*) performs the increase operation. In this case, the oil-amount control part (72*b*) of the second controller (70*b*) decreases, in the increase operation, the opening degree of the flow-rate regulating valve (41*b*) of the second compressor unit (30*b*) to be smaller than the opening degree for oil returning.

In this case, when the opening degree of the flow-rate regulating valve (41*b*) of the second compressor unit (30*b*) decreases, the amount of the refrigerating-machine oil that returns from the oil separator (35*b*) to the compressor (31*b*) decreases in the second compressor unit (30*b*), and the amount of the refrigerating-machine oil that remains in the oil separator (35*b*) increases. When the amount of the refrigerating-machine oil that remains in the oil separator (35*b*) increases, efficiency in the separation of the refrigerating-machine oil in the oil separator (35*b*) decreases. Efficiency in the separation of the refrigerating-machine oil is a ratio of "the amount of the refrigerating-machine oil that is separated from the gas refrigerant in the oil separator (35*a*, 35*b*)" to "the amount of the refrigerating-machine oil that flows together with the gas refrigerant from the compressor (31*a*, 31*b*) into the oil separator (35*a*, 35*b*)".

When efficiency in the separation of the refrigerating-machine oil in the oil separator (35*b*) decreases, the amount of the refrigerating-machine oil that flows out together with the refrigerant from the oil separator (35*b*) increases. As a result, the amount of the refrigerating-machine oil that is discharged together with the refrigerant from the second compressor unit (30*b*) increases. The refrigerating-machine oil discharged together with the refrigerant from the second compressor unit (30*b*) flows together with the refrigerant in the refrigerant circuit (20), and a portion thereof flows into the outdoor circuit (21*a*) of the first outdoor unit (11*a*) and is sucked by the compressor (31*a*) of the first compressor unit (30*a*).

As described above, when the opening degree of the flow-rate regulating valve (41*b*) of the second compressor unit (30*b*) is decreased by the oil-amount control part (72*b*) of the second controller (70*b*), a portion of the refrigerating-machine oil discharged from the second compressor unit (30*b*) is supplied to the compressor (31*a*) of the first compressor unit (30*a*). As a result, the amount of the refrigerating-machine oil that flows together with the refrigerant having a low pressure into the first compressor unit (30*a*) that has been determined to be in the oil shortage state by the first controller (70*a*) increases, and the amount of the refrigerating-machine oil held by the compressor (31*a*) of the first compressor unit (30*a*) increases.

Meanwhile, when the determination condition is not established in the oil-amount determination part (71*a*) of the first controller (70*a*) and when the determination condition is established in the oil-amount determination part (71*b*) of the second controller (70*b*), the oil-amount control part (72*a*) of the first controller (70*a*) performs the increase operation. In this case, the oil-amount control part (72*a*) of the first controller (70*a*) decreases, in the increase operation, the opening degree of the flow-rate regulating valve (41*a*) of the first compressor unit (30*a*) to be smaller than the opening degree for oil returning.

In this case, when the opening degree of the flow-rate regulating valve (41*a*) of the first compressor unit (30*a*) decreases, the amount of the refrigerating-machine oil that returns from the oil separator (35*a*) to the compressor (31*a*) decreases in the first compressor unit (30*a*), and the amount of the refrigerating-machine oil that remains in the oil separator (35*a*) increases. When the amount of the refrigerating-machine oil that remains in the oil separator (35*a*) increases, efficiency in the separation of the refrigerating-machine oil in the oil separator (35*a*) decreases.

When efficiency in the separation of the refrigerating-machine oil in the oil separator (35*a*) decreases, the amount of the refrigerating-machine oil that flows out together with the refrigerant from the oil separator (35*a*) increases. As a result, the amount of the refrigerating-machine oil that is discharged together with the refrigerant from the first compressor unit (30*a*) increases. The refrigerating-machine oil discharged together with the refrigerant from the first compressor unit (30*a*) flows together with the refrigerant in the refrigerant circuit (20), and a portion thereof flows into the outdoor circuit (21*b*) of the second outdoor unit (li*b*) and is sucked by the compressor (31*b*) of the second compressor unit (30*b*).

As described above, when the opening degree of the flow-rate regulating valve (41*a*) of the first compressor unit (30*a*) is decreased by the oil-amount control part (72*a*) of the first controller (70*a*), a portion of the refrigerating-machine oil discharged from the first compressor unit (30*a*) is supplied to the compressor (31*b*) of the second compressor unit (30*b*). As a result, the amount of the refrigerating-machine oil that flows together with the refrigerant into the second compressor unit (30*b*) that has been determined to be in the oil shortage state by the second controller (70*b*) increases, and the amount of the refrigerating-machine oil held by the compressor (31*b*) of the second compressor unit (30*b*) increases.

<Feature of Modification 1>

The refrigerant circuit (20) of the air conditioner (10) according to the present embodiment is provided with, as a throttle mechanism, the flow-rate regulating valve (41*a*, 41*b*) whose opening degree is variable. The oil-amount controller (73) performs, as the increase operation, an operation of decreasing the opening degree of the flow-rate regulating valve (41*a*, 41*b*) of "each compressor unit (30*a*, 30*b*) that has not been judged to be in the oil shortage state by the oil-amount determination part (71*a*, 71*b*)".

In the increase operation, the oil-amount controller (73) according to the present embodiment decreases the opening degree of the flow-rate regulating valve (41*a*, 41*b*) of "each compressor unit (30*a*, 30*b*) that has not been judged to be in the oil shortage state by the oil-amount determination part (71*a*, 71*b*)". When the opening degree of the flow-rate regulating valve (41*a*, 41*b*) of "each compressor unit (30*a*, 30*b*) that has not been judged to be in the oil shortage state by the oil-amount determination part (71*a*, 71*b*)" decreases, the amount of the refrigerating-machine oil that returns from the oil separator (35*a*, 35*b*) to the compressor (31*a*, 31*b*) decreases in the compressor unit (30*a*, 30*b*), and the amount of the refrigerating-machine oil present in the oil separator (35*a*, 35*b*) increases. Thus, the amount of the refrigerating-machine oil that flows out together with the refrigerant from the oil separator (35*a*, 35*b*) of the compressor unit (30*a*, 30*b*) increases.

—Modification 2 of Embodiment 1—

Each compressor unit (30*a*, 30*b*) of the present embodiment may be configured to supply the refrigerating-machine oil separated from the refrigerant in the oil separator (35*a*, 35*b*) to an intermediate port (34) of the compressor (31*a*, 31*b*).

Figure 2:
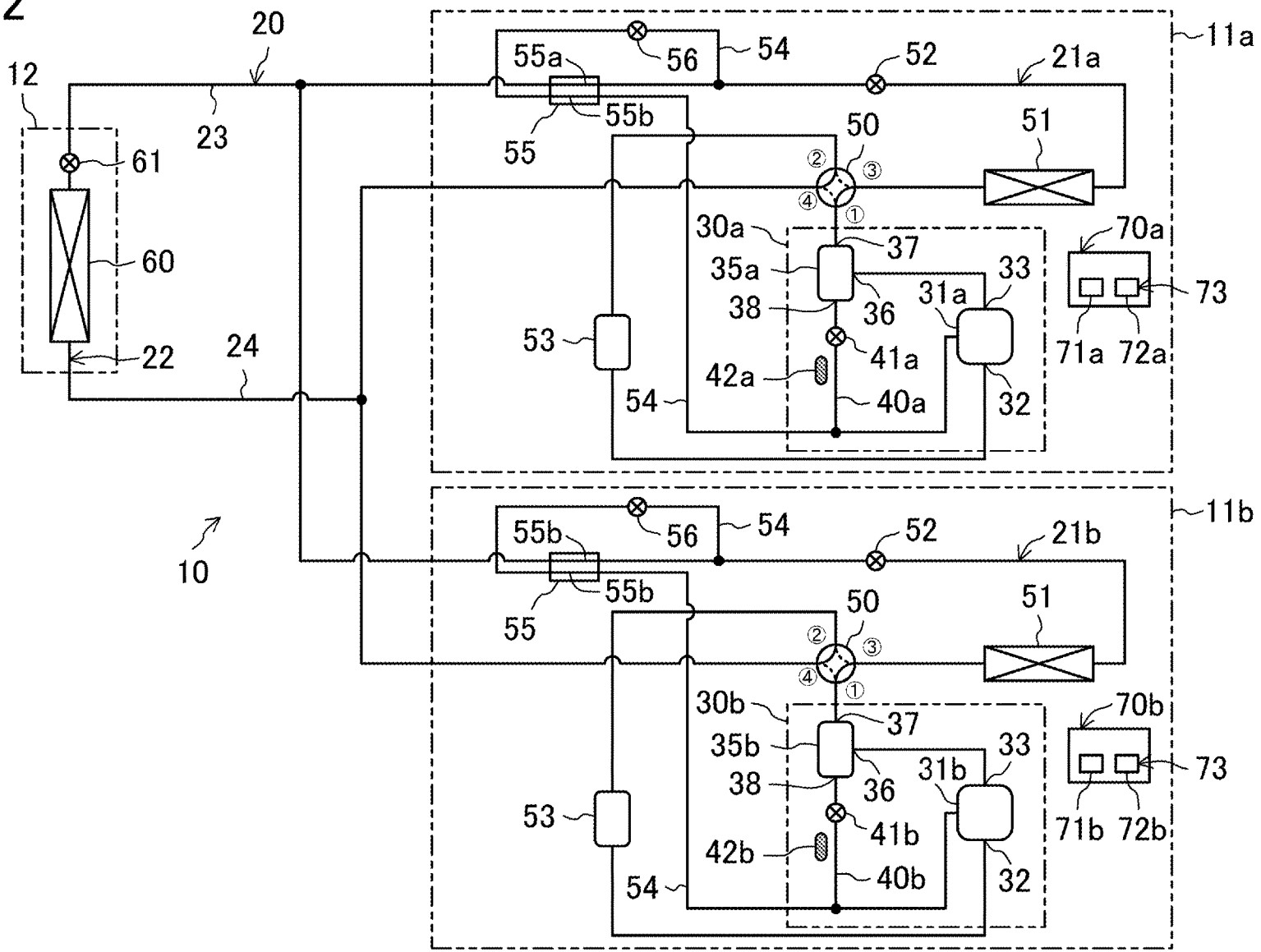
FIG. 2 is a piping system diagram illustrating a configuration of an air conditioner according to Modification 2 of the Embodiment 1.

As illustrated in FIG. 2, the other end of the subcooling circuit (54) is connected to the intermediate port (34) of the compressor (31*a*, 31*b*) in each of the outdoor circuits (21*a*, 21*b*) according to the present modification. The intermediate port (34) of the compressor (31*a*, 31*b*) is a port for introducing the refrigerant having an intermediate pressure into a compression chamber midway in a compression process.

In each compressor unit (30*a*, 30*b*) according to the present modification, the oil return pipe (40*a*, 40*b*) is connected to the downstream side of the subcooling heat exchanger (55) in the subcooling circuit (54). In each compressor unit (30*a*, 30*b*), the refrigerating-machine oil that has flowed into the oil return pipe (40*a*, 40*b*) from oil separator (35*a*, 35*b*) flows into the subcooling circuit (54) after passing through the flow-rate regulating valve (41*a*, 41*b*) and flows together with the refrigerant that flows in the subcooling circuit (54) into the compressor (31*a*, 31*b*) through the intermediate port (34) of the compressor (31*a*, 31*b*).

«Embodiment 2»

Embodiment 2 will be described. Regarding the air conditioner (10) according to the present embodiment, features that differ from those of the air conditioner (10) according to Embodiment 1 will be described here.

Figure 3:
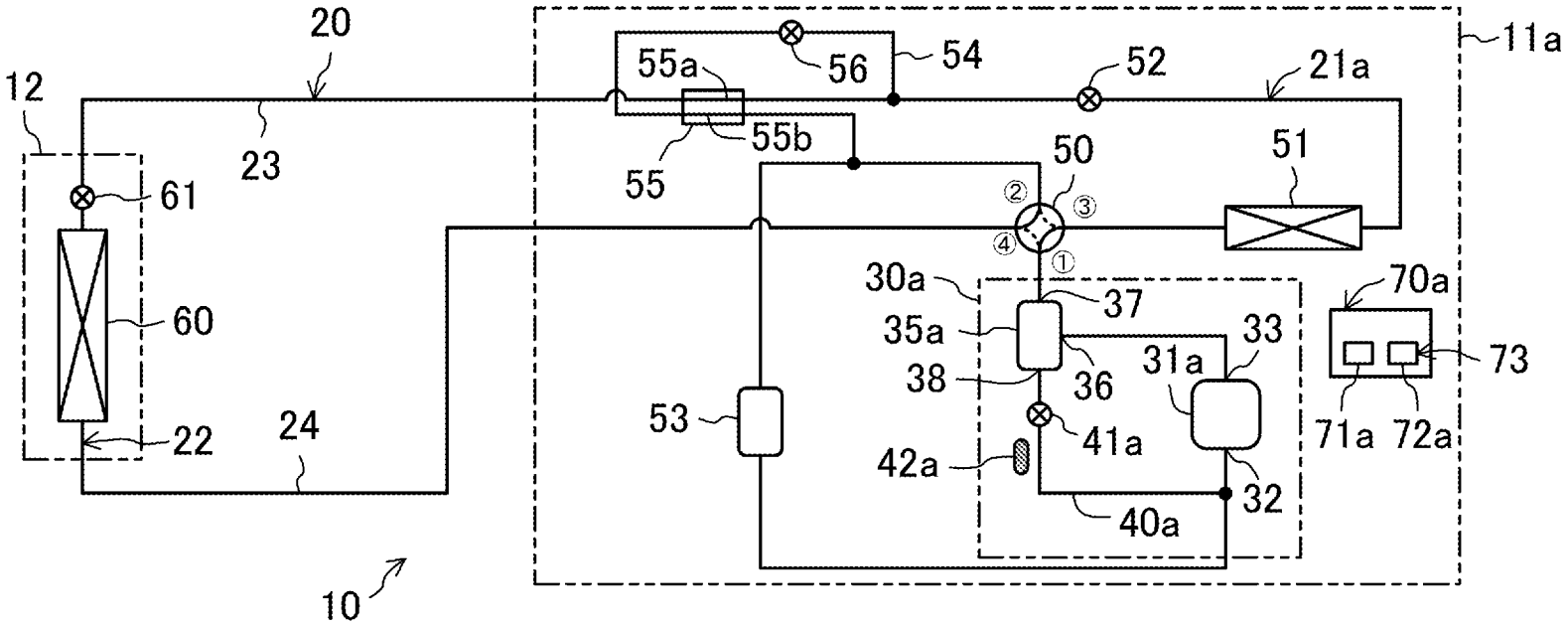
FIG. 3 is a piping system diagram illustrating a configuration of an air conditioner according to Embodiment 2.

As illustrated in FIG. 3, the air conditioner (10) according to the present embodiment includes one outdoor unit (11*a*). The outdoor unit (11*a*) includes one each of the outdoor circuit (21*a*) and the controller (70*a*), as with the first outdoor unit (11*a*) according to Embodiment 1. The configuration of the outdoor circuit (21*a*) according to the present embodiment is the same as that of the outdoor circuit (21*a*) according to Embodiment 1. Meanwhile, the controller (70*a*) according to the present embodiment differs from the first controller (70*a*) according to Embodiment 1 in terms of the operation of the oil-amount control part (72*a*).

During the cooling operation and the heating operation of the air conditioner (10), the oil-amount control part (72*a*) of the controller (70*a*) according to the present embodiment performs a predetermined increase operation when the determination condition is established in the oil-amount determination part (71*a*) of the controller (70*a*).

Specifically, the oil-amount control part (72*a*) according to the present embodiment performs, as the increase operation, an operation of forcibly increasing the rotational speed of the compressor (31*a*). When the rotational speed of the compressor (31*a*) increases, the flow velocity of the refrigerant that flows in the refrigerant circuit (20) increases. Then, the refrigerating-machine oil remaining in the pipes constituting the refrigerant circuit (20) and the heat exchangers is pushed to flow by the refrigerant and sucked together with the refrigerant by the compressor (31*a*). As a result, the amount of the refrigerating-machine oil held by the compressor (31*a*) increases.

«Embodiment 3»

Embodiment 3 will be described. Regarding the air conditioner (10) according to the present embodiment, features that differ from those of the air conditioner (10) according to Embodiment 1 will be described here.

Figure 4:
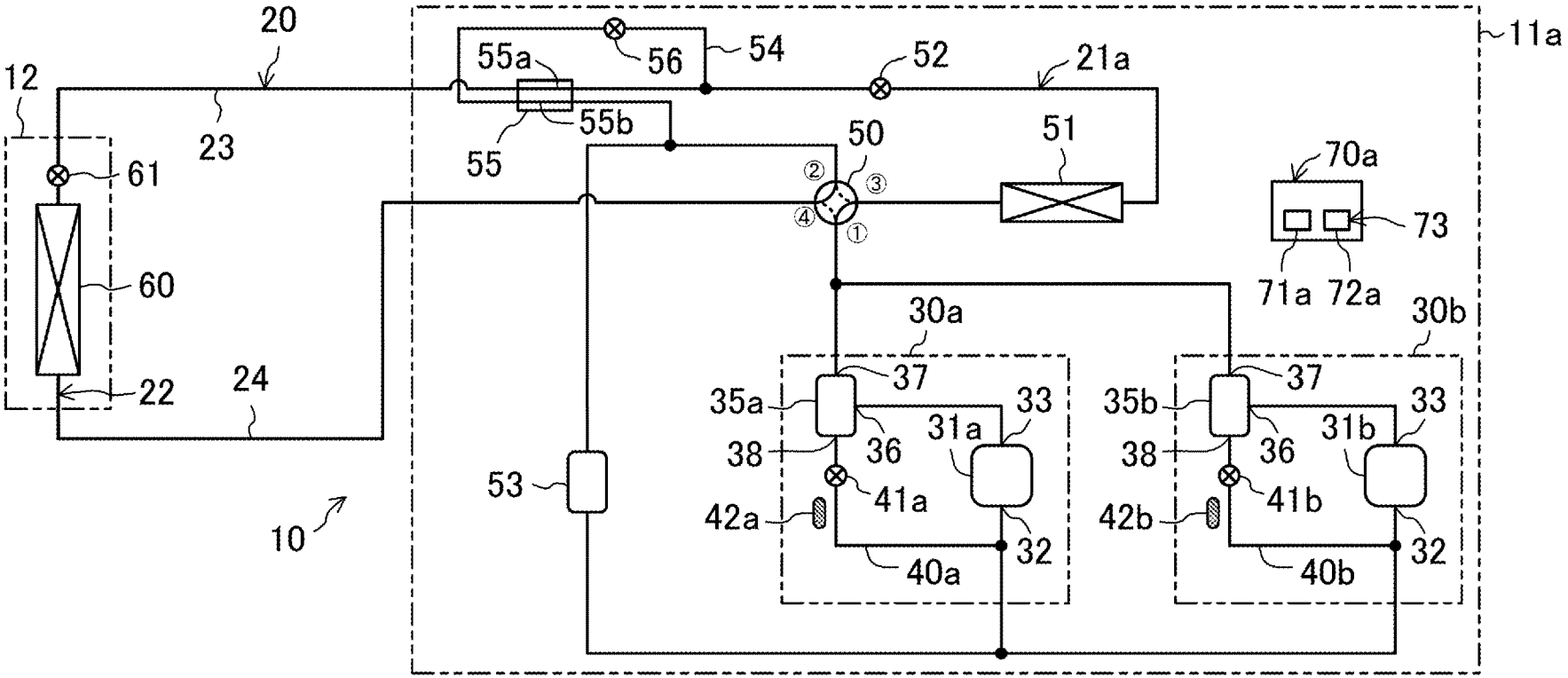
FIG. 4 is a piping system diagram illustrating a configuration of an air conditioner according Embodiment 3.

As illustrated in FIG. 4, the air conditioner (10) according to the present embodiment includes one outdoor unit (11*a*). The outdoor unit (11*a*) includes one each of the outdoor circuit (21*a*) and the controller (70*a*), as with the first outdoor unit (11*a*) according to Embodiment 1.

—Outdoor Circuit—

The outdoor circuit (21*a*) according to the present embodiment differs from the outdoor circuit (21*a*) according to Embodiment 1 in terms of including two compressor units (30*a*, 30*b*). In the outdoor circuit (21*a*) according to the present embodiment, the two compressor units (30*a*, 30*b*) are connected in parallel to each other. Specifically, the suction pipe (32) of the compressor (31*a*, 31*b*) of each compressor unit (30*a*, 30*b*) is connected to the accumulator (53), and the upper outlet (37) of the oil separator (35*a*, 35*b*) of each compressor unit (30*a*, 30*b*) is connected to the first port of the four-way switching valve (50). The outdoor circuit (21*a*) may be provided with three or more compressor units (30*a*, 30*b*).

—Controller—

The controller (70*a*) according to the present embodiment controls the flow-rate regulating valve (41*a*, 41*b*) of each compressor unit (30*a*, 30*b*). During the cooling operation and the heating operation of the air conditioner (10), the controller (70*a*), basically, sets the opening degree of the flow-rate regulating valve (41*a*, 41*b*) of each compressor unit (30*a*, 30*b*) to a preset opening degree for oil returning.

<Operation of Oil-Amount Determination Part>

In the controller (70*a*) according to the present embodiment, the oil-amount determination part (71*a*) performs the determination operation for the first compressor unit (30*a*) and the determination operation for the second compressor unit (30*b*) individually.

In the determination operation for the first compressor unit (30*a*), the oil-amount determination part (71*a*) determines whether the determination condition is established, on the basis of a measured value obtained by the temperature sensor (42*a*) of the first compressor unit (30*a*). When the determination condition that "a decrease amount of a measured value obtained by the temperature sensor (42*a*) in a predetermined reference period exceeds a predetermined reference value" is established, the oil-amount determination part (71*a*) determines that the compressor (31*a*) of the first compressor unit (30*a*) is in the oil shortage state.

In the determination operation for the second compressor unit (30*b*), the oil-amount determination part (71*a*) determines whether the determination condition is established, on the basis of a measured value obtained by the temperature sensor (42*b*) of the second compressor unit (30*b*). When the determination condition that "a decrease amount of a measured value obtained by the temperature sensor (42*b*) in a predetermined reference period exceeds a predetermined reference value" is established, the oil-amount determination part (71*a*) determines that the compressor (31*b*) of the second compressor unit (30*b*) is in the oil shortage state.

<Operation of Oil-Amount Control Part>

During the cooling operation and the heating operation of the air conditioner (10), the oil-amount control part (72*a*) of the controller (70*a*) according to the present embodiment performs a predetermined increase operation when the determination condition is established for one of the first compressor unit (30*a*) and the second compressor unit (30*b*).

When the determination condition is established in the first compressor unit (30*a*) and when the determination condition is not established in the second compressor unit (30*b*), the oil-amount control part (72*a*) performs the increase operation for the second compressor unit (30*b*). In this case, the oil-amount control part (72*a*) of the controller (70*a*) increases, in the increase operation, the opening degree of the flow-rate regulating valve (41*b*) of the second compressor unit (30*b*) to be larger than the opening degree for oil returning.

When the opening degree of the flow-rate regulating valve (41*b*) of the second compressor unit (30*b*) is increased by the oil-amount control part (72*a*) of the controller (70*a*), the amount of the refrigerating-machine oil that is discharged together with the refrigerant from the second compressor unit (30*b*) increases, as in Embodiment 1, and a portion of the refrigerating-machine oil discharged from the second compressor unit (30*b*) is supplied to the compressor (31*a*) of the first compressor unit (30*a*). As a result, the amount of the refrigerating-machine oil held by the compressor (31*a*) of the first compressor unit (30*a*) increases.

When the determination condition is not established in the first compressor unit (30*a*) and when the determination condition is established in the second compressor unit (30*b*), the oil-amount control part (72*a*) performs the increase operation for the first compressor unit (30*a*). In this case, the oil-amount control part (72*a*) of the controller (70*a*) increases, in the increase operation, the opening degree of the flow-rate regulating valve (41*a*) of the first compressor unit (30*a*) to be larger than the opening degree for oil returning.

When the opening degree of the flow-rate regulating valve (41*a*) of the first compressor unit (30*a*) is increased by the oil-amount control part (72*a*) of the controller (70*a*), the amount of the refrigerating-machine oil that is discharged together with the refrigerant from the first compressor unit (30*a*) increases, as in Embodiment 1, and a portion of the refrigerating-machine oil discharged from the first compressor unit (30*a*) is supplied to the compressor (31*b*) of the second compressor unit (30*b*). As a result, the amount of the refrigerating-machine oil held by the compressor (31*b*) of the second compressor unit (30*b*) increases.

—Modification 1 of Embodiment 3—

In the present embodiment, the oil-amount control part (72*a*) of the controller (70*a*) may perform, as the increase operation, an operation of decreasing the opening degree of the flow-rate regulating valve (41*a*) of the compressor unit (30*a*).

When the determination condition is established in the first compressor unit (30*a*) and when the determination condition is not established in the second compressor unit (30*b*), the oil-amount control part (72*a*) performs the increase operation for the second compressor unit (30*b*). In this case, the oil-amount control part (72*a*) of the controller (70*a*) decreases, in the increase operation, the opening degree of the flow-rate regulating valve (41*b*) of the second compressor unit (30*b*) to be smaller than the opening degree for oil returning.

When the opening degree of the flow-rate regulating valve (41*b*) of the second compressor unit (30*b*) is decreased by the oil-amount control part (72*a*) of the controller (70*a*), the amount of the refrigerating-machine oil that is discharged together with the refrigerant from the second compressor unit (30*b*) increases, as in Modification 1 of Embodiment 1, and a portion of the refrigerating-machine oil discharged from the second compressor unit (30*b*) is supplied to the compressor (31*a*) of the first compressor unit (30*a*). As a result, the amount of the refrigerating-machine oil held by the compressor (31*a*) of the first compressor unit (30*a*) increases.

When the determination condition is not established in the first compressor unit (30*a*) and when the determination condition is established in the second compressor unit (30*b*), the oil-amount control part (72*a*) performs the increase operation for the first compressor unit (30*a*). In this case, the oil-amount control part (72*a*) of the controller (70*a*) decreases, in the increase operation, the opening degree of the flow-rate regulating valve (41*a*) of the first compressor unit (30*a*) to be smaller than the opening degree for oil returning.

When the opening degree of the flow-rate regulating valve (41*a*) of the first compressor unit (30*a*) is decreased by the oil-amount control part (72*a*) of the controller (70*a*), the amount of the refrigerating-machine oil that is discharged together with the refrigerant from the first compressor unit (30*a*) increases, as in Modification 1 of Embodiment 1, and a portion of the refrigerating-machine oil discharged from the first compressor unit (30*a*) is supplied to the compressor (31*b*) of the second compressor unit (30*b*). As a result, the amount of the refrigerating-machine oil held by the compressor (31*b*) of the second compressor unit (30*b*) increases.

—Modification 2 of Embodiment 3—

Each compressor unit (30*a*, 30*b*) according to the present embodiment may be configured, as in Modification 2 of Embodiment 1, to supply the refrigerating-machine oil separated from the refrigerant in the oil separator (35*a*, 35*b*) to the intermediate port (34) of the compressor (31*a*, 31*b*).

In the outdoor circuit (21*a*) according to the present modification, a branch pipe connected to the intermediate port (34) of the compressor (31*a*) of the first compressor unit (30*a*) and a branch pipe connected to the intermediate port of the compressor (31*b*) of the second compressor unit (30*b*) are provided at the other end of the subcooling circuit (54). In the first compressor unit (30*a*), the oil return pipe (40*a*) is connected to the branch pipe of the subcooling circuit (54) connected to the intermediate port (34) of the compressor (31*a*). In the second compressor unit (30*b*), the oil return pipe (40*b*) is connected to the branch pipe of the subcooling circuit (54) connected to the intermediate port (34) of the compressor (31*b*).

—Modification 3 of Embodiment 3—

Figure 5:
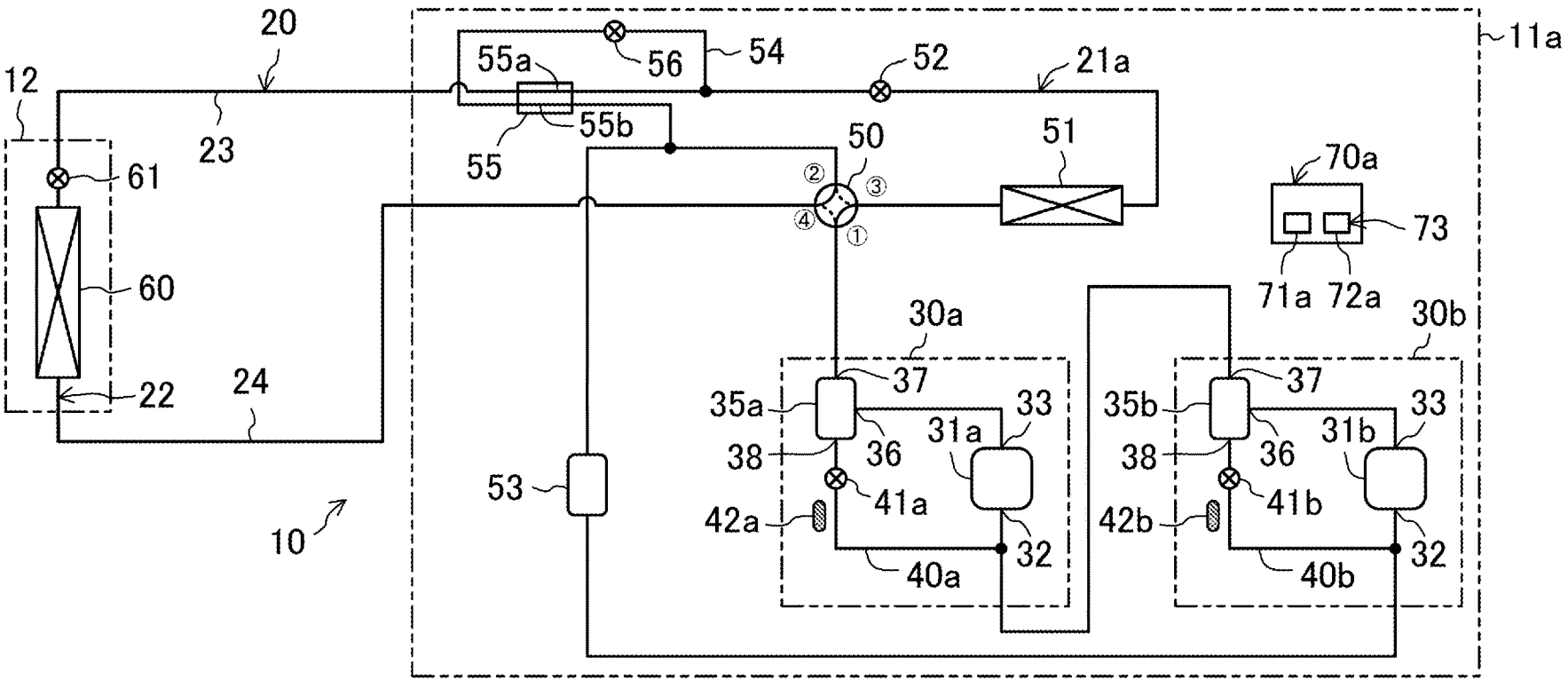
FIG. 5 is a piping system diagram illustrating a configuration of an air conditioner according to Modification 3 of the Embodiment 3.

As illustrated in FIG. 5, the first compressor unit (30*a*) and the second compressor unit (30*b*) may be connected in series in the outdoor circuit (21*a*) according to the present embodiment. In the outdoor circuit (21*a*) according to the present modification, the suction pipe (32) of the compressor (31*b*) of the second compressor unit (30*b*) is connected to the accumulator (53), the upper outlet (37) of the oil separator (35*b*) of the second compressor unit (30*b*) is connected to the suction pipe (32) of the compressor (31*a*) of the first compressor unit (30*a*), and the upper outlet (37) of the oil separator (35*a*) of the first compressor unit (30*a*) is connected to the first port of the four-way switching valve (50).

«Other Embodiments»

The intended use of the refrigeration apparatus in each embodiment described above is not limited to an indoor air-conditioning. These refrigeration apparatuses may be used for cooling the inside of a refrigerator or the like.

Although embodiments and modifications have been described above, it should be understood that various changes in the forms and the details are possible without departing from the gist and the scope of the claims. The above embodiments and modifications may be combined and replaced, as appropriate, as long as the object functions of the present disclosure are not lost.

EXPLANATION OF REFERENCES

10 air conditioner (refrigeration apparatus)
20 refrigerant circuit
30*a* first compressor unit
30*b* second compressor unit
31*a*, 31*b* compressor
35*a*, 35*b* oil separator
40*a*, 40*b* oil return pipe
41*a*, 41*b* flow-rate regulating valve (throttle mechanism)
42*a*, 42*b* temperature sensor
71*a*, 71*b* oil-amount determiner
73 oil-amount controller

The invention claimed is:

1. A refrigeration apparatus comprising a refrigerant circuit provided with a compressor, an oil separator configured to separate a refrigerant and a refrigerating-machine oil that are discharged from the compressor from each other, an oil return pipe for returning the refrigerating-machine oil in the oil separator to the compressor, and a throttle mechanism configured to decompress a fluid that flows in the oil return pipe, the refrigeration apparatus being configured to perform a refrigeration cycle by circulating a refrigerant in the refrigerant circuit, wherein the refrigeration apparatus comprises:

a controller;

a temperature sensor configured to measure, downstream of the throttle mechanism, a temperature of a fluid that flows in the oil return pipe, wherein the controller is configured to:

perform a determination operation of determining whether an oil shortage state in which an amount of the refrigerating-machine oil held by the compressor is insufficient is present, based on a measured value obtained by the temperature sensor; and perform, as the determination operation, an operation of determining whether the oil shortage state is present, based on a temporal change in a measured value obtained by the temperature sensor, wherein the controller is further configured to perform, as the determination operation, an operation of determining that the oil shortage state is present, when a decrease amount of a measured value obtained by the temperature sensor in a predetermined reference period exceeds a predetermined reference value.

2. The refrigeration apparatus according to claim 1, wherein the refrigerant circuit includes a plurality of compressor units each including the compressor, the oil separator, the oil return pipe, and the throttle mechanism, the temperature sensor is provided at each of the plurality of compressor units, and the controller is further configured to perform the determination operation for each of the plurality of compressor units.

3. The refrigeration apparatus according to claim 1, wherein the refrigerant circuit includes a plurality of compressor units each including the compressor, the oil separator, the oil return pipe, and the throttle mechanism, the temperature sensor is provided at each of the plurality of compressor units, and the controller is further configured to perform the determination operation for each of the plurality of compressor units.

4. The refrigeration apparatus according to claim 3, wherein the refrigeration apparatus comprises an oil-amount controller within the controller configured to perform, when the controller determines that some or one of the compressor units is in the oil shortage state, an increase operation to increase an amount of the refrigerating-machine oil that is discharged from the compressor of each compressor unit that has not been judged to be in the oil shortage state by the controller.

5. The refrigeration apparatus according to claim 4, wherein a flow-rate regulating valve whose opening degree is variable is provided as the throttle mechanism in the refrigerant circuit, and the oil-amount controller is further configured to perform, as the increase operation, an operation of increasing an opening degree of the flow-rate regulating valve of each compressor unit that has not been judged to be in the oil shortage state by the controller.

6. The refrigeration apparatus according to claim 4, wherein a flow-rate regulating valve whose opening degree is variable is provided as the throttle mechanism in the refrigerant circuit, and the oil-amount controller is further configured to perform, as the increase operation, an operation of decreasing an opening degree of the flow-rate regulating valve of each compressor unit that has not been judged to be in the oil shortage state by the controller.

7. A refrigeration apparatus comprising a refrigerant circuit provided with a compressor, an oil separator configured to separate a refrigerant and a refrigerating-machine oil that are discharged from the compressor from each other, an oil return pipe for returning the refrigerating-machine oil in the oil separator to the compressor, and a throttle mechanism configured to decompress a fluid that flows in the oil return pipe, the refrigeration apparatus being configured to perform a refrigeration cycle by circulating a refrigerant in the refrigerant circuit, wherein the refrigeration apparatus comprises:

a controller;

a temperature sensor configured to measure, downstream of the throttle mechanism, a temperature of a fluid that flows in the oil return pipe, wherein the controller is configured to:

perform a determination operation of determining whether an oil shortage state in which an amount of the refrigerating-machine oil held by the compressor is insufficient is present, based on a measured value obtained by the temperature sensor; and perform, as the determination operation, an operation of determining whether the oil shortage state is present, based on a temporal change in a measured value obtained by the temperature sensor, wherein the refrigerant circuit includes a plurality of compressor units each including the compressor, the oil separator, the oil return pipe, and the throttle mechanism, the temperature sensor is provided at each of the plurality of compressor units, and the controller is further configured to perform the determination operation for each of the plurality of compressor units, and wherein the refrigeration apparatus comprises an oil-amount controller within the controller configured to perform, when the controller determines that some or one of the compressor units is in the oil shortage state, an increase operation to increase an amount of the refrigerating-machine oil that is discharged from the compressor of each compressor unit that has not been judged to be in the oil shortage state by the controller.

8. The refrigeration apparatus according to claim 7, wherein a flow-rate regulating valve whose opening degree is variable is provided as the throttle mechanism in the refrigerant circuit, and the oil-amount controller is configured to perform, as the increase operation, an operation of increasing an opening degree of the flow-rate regulating valve of each compressor unit that has not been judged to be in the oil shortage state by the controller.

9. The refrigeration apparatus according to claim 7, wherein a flow-rate regulating valve whose opening degree is variable is provided as the throttle mechanism in the refrigerant circuit, and the oil-amount controller is configured to perform, as the increase operation, an operation of decreasing an opening degree of the flow-rate regulating valve of each compressor unit that has not been judged to be in the oil shortage state by the controller.

* * * * *